United States Patent [19]

Mayr et al.

[11] 4,241,707

[45] Dec. 30, 1980

[54] ACTIVATING MECHANISM FOR THE WORKING MEDIUM VALVES OF A RECIPROCATING PISTON ENGINE WITH HYDRAULIC PLAY COMPENSATING ELEMENTS

[75] Inventors: Bertold Mayr, Beutelsbach; Siegfried Röser, Baltmannsweiler, both of Fed. Rep. of Germany

[73] Assignee: Daimler-Benz Aktiengesellschaft, Fed. Rep. of Germany

[21] Appl. No.: 565,073

[22] Filed: Apr. 4, 1975

[30] Foreign Application Priority Data

Apr. 6, 1974 [DE] Fed. Rep. of Germany ..... 2416910

[51] Int. Cl.[3] ..... F01L 1/14; F01L 1/24

[52] U.S. Cl. ..... 123/90.55

[58] Field of Search ..... 123/90.52, 90.53, 90.54, 123/90.55, 90.56, 90.57, 90.58, 90.59, 90.33, 90.35, 90.27, 90.36, 90.37, 90.43

[56] References Cited

U.S. PATENT DOCUMENTS

| | | | |
|---|---|---|---|
| 1,062,580 | 5/1913 | Bollee | 123/90.59 |
| 2,246,330 | 6/1941 | Voorhies | 123/90.56 |
| 2,667,149 | 1/1954 | Purchas | 123/90.55 |
| 2,673,555 | 3/1954 | Randol | 123/90.55 |
| 2,865,353 | 12/1958 | Sampietro | 123/90.43 |
| 2,971,503 | 2/1961 | Schnabel | 123/90.43 |
| 3,286,702 | 11/1966 | Dadd | 123/90.55 |
| 3,658,038 | 4/1972 | Bergmann | 123/90.55 |
| 3,716,036 | 2/1973 | Kruger | 123/90.43 |
| 3,875,908 | 4/1975 | Ayres | 123/90.37 |

FOREIGN PATENT DOCUMENTS

| | | | |
|---|---|---|---|
| 303025 | 11/1954 | Switzerland | 123/90.54 |

*Primary Examiner*—Wendell E. Burns

*Attorney, Agent, or Firm*—Craig and Antonelli

[57] ABSTRACT

An actuating installation for working medium valves in reciprocating engines with at least one cam shaft and one cam each for each valve and with at least an indirect actuation of the valves by the corresponding cam, and with hydraulic play-compensating elements, each of which is provided with one working space filled with lubricating oil that is connected to the oil circulatory system of the reciprocating piston engine; the place of the hydraulic connection of the play-compensating elements with the oil lubricating system is located at such a place in this circulatory system, at which the oil circulatory system has a pressure, conditioned on the system, which at all operating conditions lies below the feed pressure of the circulation but above the atmospheric air pressure of the reciprocating engine.

8 Claims, 1 Drawing Figure

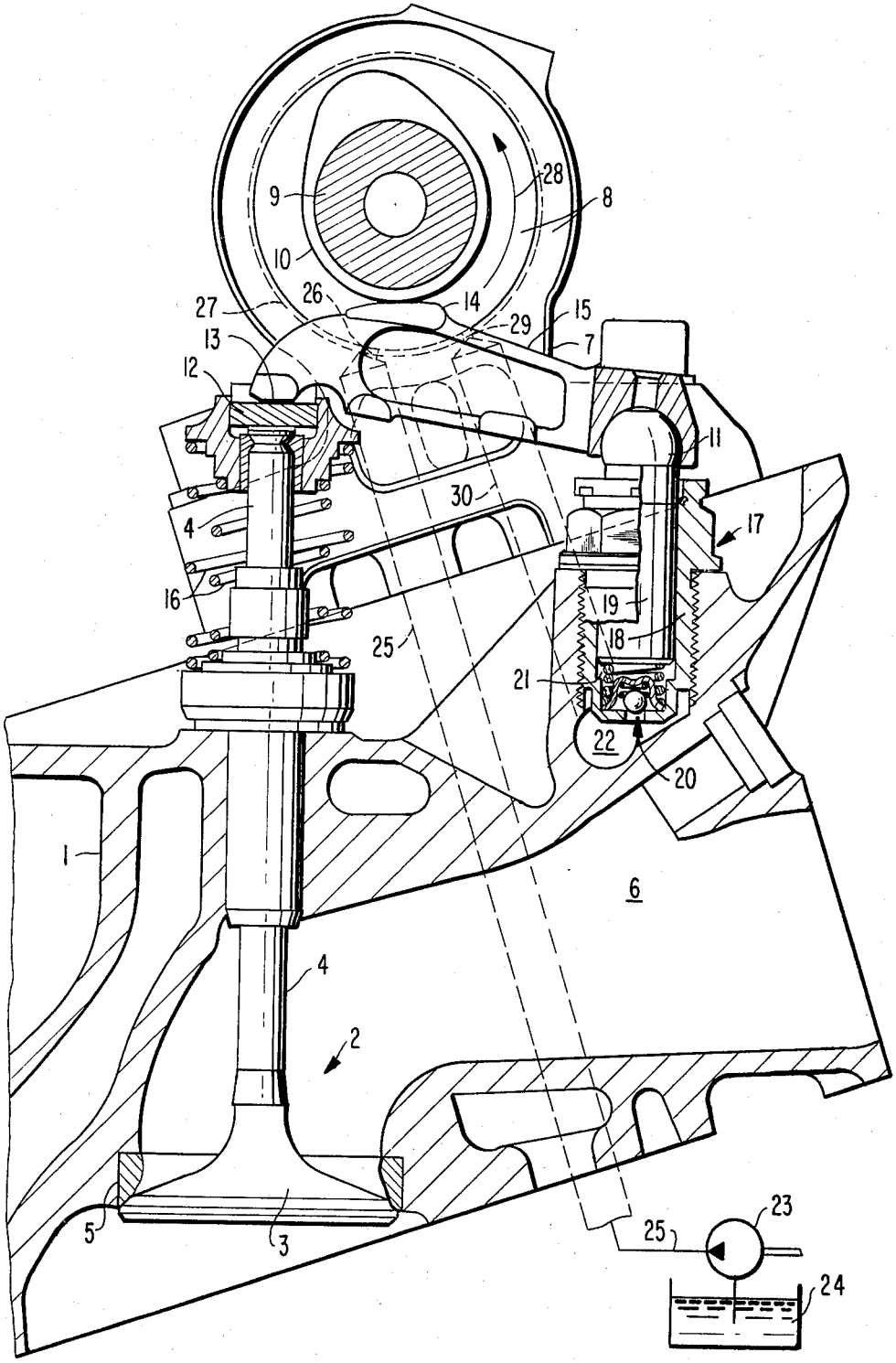
9
28
8
10
27
26
14
29
15
7
13
12
11
30
4
17
16
19
18
25
21
22
20
1
6
4
2
5
3
25
23
24

ACTIVATING MECHANISM FOR THE WORKING MEDIUM VALVES OF A RECIPROCATING PISTON ENGINE WITH HYDRAULIC PLAY COMPENSATING ELEMENTS

The present invention relates to an actuating installation for the working medium valves in a reciprocating piston engine with at least one cam shaft and with one cam for each valve and with at least an indirect actuation of the valve by the corresponding cam, with one hydraulic play-compensating element arranged in the flow of power between each cam and the associated valve tappet or the corresponding play-compensating element arranged at a place transmitting the actuating reaction forces into the engine frame, whereby each compensating element includes one working space filled with lubricating oil and adapted to be loaded by the actuating forces or by the reaction forces, which working space is connected respectively to the lubricating oil circulation of the reciprocating piston engine.

Experience has demonstrated that the oil in the lubricating oil circulatory systems of reciprocating piston internal combustion engines is by no means in a liquid form free of bubbles, but exists in the form of a more or less strongly air-containing foam and circulates in this form in the circulatory system and reaches the various load places. This high proportion of air in the oil, however renders the medium compressible which is absolutely non-permissive for the oil volume enclosed by the working space of the hydraulic play-compensating elements and for the operation of the play-compensating elements.

The working spaces of the hydraulic play-compensating elements are subjected to only a slight overpressure or excess pressure during the periods of time in which the associated valves are in the rest position. The full feed pressure of the lubricating oil circulatory system would effect an excessive abutment of the cam and of the cam counter-surface, which contact with each other only along a line-shaped strip and during the rest phase are in contact at the cam counter-surface always at the same place; as a result thereof, the liquid friciton would be lost and at least partly a dry friction would result, which would cause the sliding surfaces to be subjected to mutual wear and seizing. Consequently, a pressure decrease from the feed pressure of the lubricating oil circulation to a lesser pressure acting upon the working spaces of the hydraulic play-compensating elements is necessary.

This pressure decrease may take place, for example, in that a line acted upon with the feed pressure of the lubricating oil circulation is tapped by way of a throttle nozzle of defined cross section and is relieved to the return pressure by way of a pressure-limiting valve of this partial stream. A pressure which as regards its magnitude can be used for the actuation of the play-compensating elements, prevails in the line section between the throttle and the pressure-limiting valve with a suitable dimensioning of these parts. However, it is thereby disadvantageous that a certain lubricating oil quantity has to be removed from the lubricating oil circulatory system for this pressure generation, which additionally constitutes a load on the lubricating oil circulation as regards quantity. The circulating velocity of the lubricating oil circulation is increased thereby, which favors the entry of air into the oil, reduces the stay in the oil sump and decreases the level in the oil sump; breathing-in or sniffling-in actions of air are more readily possible as a result thereof. Owing to the continuous flow of oil in the branch of the oil circulatory system serving for the production of the lower pressure for the play-compensating elements, oil still containing a large amount of air naturally flows thereat. One has therefore already provided venting means at the play-compensating elements (German Offenlegungsschrift No. 1,451,940). It would also be possible to conduct the oil in the aforementioned pressure-reducing branch over bodies of large surface, for example, over sifting or strainer heap structures, so-called defoamers, before the oil is conducted into the play-compensating elements. However, these measures ential only a partial success since they cannot avoid a reliable air separation of the oil in the play-compensating element and therewith cannot avoid a residual compressibility. The play-compensating elements then act at best as a more or less hard spring. As to the rest, the so-called defoamers cannot be accommodated at all for the most part in proximity to the play-compensating elements for space reasons.

It is the aim of the present invention to provide a pressure supply of the hydraulic play-compensating elements which practically does not load the lubricating oil circulation as regards quantity and which is constructively more simple than the known pressure supplies or feeds. The underlying problems are solved according to the present invention in that the place of the hydraulic connection of the play-compensating elements with the lubricating oil circulation (bleeding or tapping place) is located at such a place in this circulation, at which the lubricating oil circulation exhibits a pressure, conditioned on the system, which at all operating conditions lies below the feed or inlet pressure of the circulation but above the atmospheric air pressure of the reciprocating piston engine.

Owing to the tapping of a place of the lubricating oil circulation, at which a suitable pressure is present already anyhow, the measures for a separate pressure decrease can be dispensed with and—which is even more important—also the partial stream necessary therefor can be dispensed with. This is so as no liquid is removed at the tapping place, apart from the very slight leakage quantities of the working spaces of the play-compensating elements, and correspondingly only a pressure is superimposed; however, the circulation is not loaded as regards quantity. By reason of the very slight flow velocity in the tap line—only the leakage quantities flow therethrough—a calming and air separation will occur in the tap line so that air-free oil is available at the play-compensating elements. The tapping pressure, however, may also be transmitted by way of an air-containing oil.

In order to favor an air separation out of the oil of the tap line back into the oil circulation, it is appropriate if the tapping place lies geodetically higher in the operating position of the reciprocating engine than the play-compensating elements and if the tap line extends at least within the area following that tapping place as steeply as possible with an always unequivocal drop. In the arrangement of the tap line, attention must be paid to the fact that no air pockets can remain by reason of air separations at certain places. The air bubbles rising in the dropping tap line return to the oil circulation by way of the tapping place whereas in contrast thereto, the vented air tapped for the play-compensating elements flows downwardly in the tap line toward the play-compensating elements. In order to obtain a particularly good venting of the oil in the tap line, it is advantageous if the tap line has as large as possible a cross section at least within the area of its drop, in such a manner that the flow velocity of the oil therein is smaller than the velocity of the formation of the air bubbles. A calming path or distance, so to speak of, is created thereby in which the oil nearly stagnates.

Frequently, a slide bearing place connected to the lubricating oil circulation, for example, a cam shaft bearing is arranged geodetically above the play-compensating elements. In these cases, the tapping place may terminate in an advantageous manner in the slide gap of such a slide bearing at a circumferential position slightly offset in the direction of rotation of the bearing with respect to the connecting place of the slide bearing to the lubricating oil circulation (feed place). Such slide bearing gaps represent favorable pressure-reducing distances which are present already anyhow and which are well utilizable for the instant purposes. Appropriately, the tapping place is offset in the direction of rotation of the bearing with respect to the feed place, the offset-distance being less than the axial length of the slide bearing. A sufficiently high pressure is always assured at this place also under unfavorable conditions. The tapping place and the feed place can thereby be connected with each other by a groove at least partly surrounding the slide bearing in the circumferential direction.

Accordingly, it is an object of the present invention to provide an actuating installation for the working medium valves in a reciprocating piston engine with hydraulic play-compensating elements which avoids by simple means the aforementioned short-comings and drawbacks encountered in the prior art.

Another object of the present invention resides in an actuating system for the working medium valves of a reciprocating piston internal combustion engine with hydraulic play-compensating elements, in which the play-compensating elements are supplied with an oil free of air by extremely simple means.

A further object of the present invention resides in a feed system for supplying the play-compensating elements in valve actuating mechanisms of internal combustion engines with oil substantially free of air from the oil circulatory system, yet avoids the need for separate air separators or the like.

Still a further object of the present invention resides in an actuating system for the valves of internal combustion engines equipped with valve-play compensating elements of the type described above, which ensures a reliable air separation of the oil in the play-compensating elements and thus avoids a residual compressibility without the need of defoamers.

Another object of the present invention resides in a feed system for the play-compensating elements of valve actuating mechanisms of reciprocating piston engines in which the valve compensating elements are fed from the oil circulatory system practically without loading the lubricating oil circulation as regards quantity and with the use of extraordinarily simple means from a constructive point of view.

A still further object of the present invention resides in a system of the type described above which assures proper operation of the valve-compensating elements under all operating conditions including even unfavorable operating conditions.

These and further objects, features and advantages of the present invention will become more apparent from the following description when taken in connection with the accompanying drawing which shows, for purposes of illustration only, one embodiment in accordance with the present invention, and wherein:

The single FIGURE is a cross-sectional view through the valve-actuation of a reciprocating piston engine with hydraulic play-compensating elements and a pressure supply in accordance with the present invention.

Referring now to the single FIGURE of the drawing, the cross-sectional view illustrates a cylinder head 1 which includes a working medium channel 6 adapted to be closed by means of a valve generally designated by reference numeral 2 and having a valve disk 3, a valve shaft 4, a valve seat 5 and valve springs 16, a cam shaft 9 having a cam 10 for actuating the valve and supported on the cylinder head 1 by means of a bearing support 7 provided with the bearing 8, and a valve rocker 15 supported on the counter-support 11 and abutting without play at the valve lift or pressure member 12 and at the cam surface 10 by means of its working surfaces 13 and 14. The rocker arm counter-abutment 11 partially absorbs the reaction forces during the valve actuation by the cam 10 and the rocker arm 15. A hydraulic play-compensating element generally designated by reference numeral 17 and absorbing the reaction forces is arranged in the flow path of power between the counter-abutment 11 and the cylinder head 1, which in the rest phase of the valve 2 and of the cam 10 exerts on the counter-abutment 11 an upwardly directed force eliminating the play in the flow path of the actuating force of the valve. The play-compensating element 17 includes a piston 19 sliding within the cylinder 18 and fixedly connected with the abutment 11, which together with the housing 18 forms a working space 21 adapted to be closed in the inflow direction toward the working space by an open check valve 20. A rocker arm, a cam and a play-compensating element belong to each valve of the reciprocating engine. The play-compensating elements arranged in a row one behind the other, are in communication with their inlet aperture (valve 20) with the longitudinal line 22. This longitudinal line 22 is connected at a suitable place with the lubricating oil circulatory system of the reciprocating engine in such a manner that the lubricating oil circulation is not loaded thereby as regards quantity and vented oil reaches the play-compensating elements 17. The play-compensating elements 17 exhibit a slight rate of oil flow since the piston 19 continuously carries out small oscillatory movements in the housing 18 during each valve opening operation and a slight quantity of oil leaks constantly through the gap between the piston 19 and the housing 18. This is necessary already for lubricating reasons. The oil flowing out of the longitudinal line 22 by way of the check valve 20 into the working space 21 has to be far-reachingly free of air in order that the oil cushion present in the working space 21 is incompressible and the abutment 11 does not yield under the valve-actuating forces. On the one hand, the leakage oil must be always supplied under an unequivocally positive excess or overpressure under all possible operating conditions, but on the other hand, this pressure must not be excessively high as otherwise the surface pressure between the slide surfaces of the cam 10 and the rocker arm back 14 becomes too high (line contact), and especially in the illustrated rest phase (standstill of the contact line on the rocker arm back 14) the danger exists of a half-dry friction and of seizing.

The oil circulatory system of the reciprocating engine is indicated only schematically and only incompletely with a lubricating oil pump 23, a pump sump 24, and a feed line 25. The oil returns into the pump sump 24 from the load places by dripping off and running off along the surface. The feed line 25 branches off into the entire reciprocating engine and extends also up to the cylinder head 1 and the bearing support 7 of the cam shaft 9. At the end of the feed line 25 in the bearing support 7 the lubricating oil reaches by way of a throttling place 26 determining the lubricating quantity of the bearing—feed place of the bearing—a circumferential groove 27 surrounding the cam shaft bearing 8 which distributes the lubricating oil supplied on one side in the circumferential direction of the bearing. At the throttle 26, the lubricating oil pressue decreases from the feed pressure to the bearing feed pressure which can be measured directly downstream of the throttle 26 in the groove 27. The pressure in the groove 27 decreases in the direction of rotation of the bearing indicated by arrow 28—starting from the bearing inlet pressure at the feed place 26—by reason of axial discharges into the slide gap. A reduction of the pressue to such a level has thereby taken place in a natural, system-conditioned manner approximately 30° to 45° in the direction of rotation downstream of the feed place, as is favorable for a pressure supply of the play-compensating elements 17. The lubricating system of the reciprocating engine is being tapped at this place by way of a small bore 29 tapping the groove 27 to provide a pressure supply of the play-compensating elements (tapping place with corresponding tap pressure). As a result of a tap line 30 which from the tapping place that is disposed geodetically higher compared to the play-compensating elements, extends sloping and dropping down to the longitudinal line 22, this tapping pressure is further transmitted to the play-compensating elements 17. By reason of the large cross-sectional dimension of the tap line 30 and of the tapped quantities which are anyhow only very slight, the tapped oil nearly stagnates in the line 30. Any still contained air inclusions can return in the form of bubbles to the tapping place 29 thanks to the dropping arrangement of the tap line 30. Until a predetermined oil volume in the tap line 30 has dropped down to the longitudinal line 22 by reason of the leakage losses, it has had sufficient time in order to separate out a sufficient quantity of air.

The advantages of the pressure supply of the hydraulic play-compensating elements, according to the present invention, reside in that the individual parts for a separate pressure reduction are economized, that the oil circulation system is less loaded as regards quantity which reduces the air inclusion in the lubricating oil, and in that by reason of a calming of the oil and a dropping oil supply, an effective air separation takes place prior to the entry of the oil into the play-compensating elements which brings about an improved operation thereof. Additionally, the inlet pressure is reliably limited to permissive values.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An actuating installation for working medium valve means in a reciprocating engine, which includes an oil circulatory system, at least one cam shaft and one cam means each for each valve means and at least an indirect actuation of the valve means by the corresponding cam means, and hydraulic play-compensating means which are provided with working space means filled with lubricating oil, characterized in that the place of the hydraulic connection of the play-compensating means with the oil circulatory system is located at such a place in said circulatory system at which the oil circulatory system possesses a pressure which lies in all operating conditions below the feed pressure of the circulatory system but above the atmospheric air pressure of the reciprocating engine, and in that the hydraulic play-compensating means are arranged at a place where the actuating reaction forces are transmitted into an engine frame.

2. An actuating installation for working medium valve means in a reciprocating engine, which includes an oil circulatory system, at least one cam shaft and one cam means each for each valve means and at least an indirect actuation of the valve means by the corresponding cam means, hydraulic play compensating means which are provided with working space means filled with lubricating oil, a tap line operatively connected to the lubricating oil circulatory system, and slide bearing means arranged geodetically above the play-compensating means and operatively connected with the lubricating oil circulatory system, characterized in that the place of the hydraulic connection of the play-compensating means with the oil circulatory system is located at such a place in the circulatory system at which the oil circulatory system possesses a pressure which lies in all operating conditions below the feed pressure of the circulatory system but above the atmospheric air pressure of the reciprocating engine, in the operating position of the reciprocating engine, the tapping place is located geodetically higher than the play-compensating means, the tap line extends at least within the area downstream of the tapping place relatively steeply and always with an unequivocal drop, the tap line has a relatively large cross section at least within its dropping area in such a manner that the flow velocity of the oil therein is smaller than the velocity of the formation of air bubbles, and in that the tap place for the play-compensating means terminates in a slide gap of the slide bearing means at a circumferential position slightly offset in a direction of rotation of the bearing means with respect to the place of connection of the slide bearing means to the lubricating oil circulatory system.

3. An installation according to claim 2, characterized in that the slide bearing means are cam shaft bearings.

4. An installation according to claim 2, characterized in that the tapping place of the tap line is arranged offset in the direction of rotation of the bearing means with respect to the feed place thereof by the lubricating oil circulatory system.

5. An installation according to claim 4, characterized in that the tapping place and the feed place are connected with each other by a groove at least partly surrounding the slide bearing means in the circumferential direction.

6. An actuating installation for working medium valve means in a reciprocating engine, which includes an oil circulatory system, at least one cam shaft and one cam means each of each valve means and at least an indirect actuation of the valve means by the corresponding cam means, hydraulic play-compensating means which are provided with working space means filled with lubricating oil, and slide bearing means arranged geodetically above the play-compensating means and operatively connected with the lubricating oil circulatory system, characterized in that the place of the hydraulic connection of the play-compensating means with the oil circulatory system is located at such a place in said circulatory system at which the oil circulatory system possesses a pressure which lies in all operating conditions below the feed pressure of the circulatory system but above the atmospheric air pressure of the reciprocating engine, and in that a tap place for the play-compensating means terminates in a slide gap of the slide bearing means at a circumferential position slightly offset in the direction of rotation of the bearing means with respect to the place of connection of the slide bearing means to the lubricating oil circulatory system.

7. An installation according to claim 6, characterized in that the tapping place of the tap line is arranged offset in the direction of rotation of the bearing means with respect to the feed place thereof by the lubricating oil circulatory system.

8. An installation according to claim 6, characterized in that the tapping place and the feed place are connected with each other by a groove at least partly surrounding the slide bearing means in the circumferential direction.

* * * * *